US006786940B1

(12) United States Patent
Wenderoth et al.

(10) Patent No.: US 6,786,940 B1
(45) Date of Patent: Sep. 7, 2004

(54) PARAFFIN DISPERSANTS WITH A LUBRICITY EFFECT FOR DISTILLATES OF PETROLEUM PRODUCTS

(75) Inventors: Bernd Wenderoth, Lampertheim (DE); Dieter Hermeling, Böhl-Iggelheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/830,149

(22) PCT Filed: Oct. 19, 1999

(86) PCT No.: PCT/EP99/07899

§ 371 (c)(1),
(2), (4) Date: Apr. 23, 2001

(87) PCT Pub. No.: WO00/23541

PCT Pub. Date: Apr. 27, 2000

(30) Foreign Application Priority Data

Oct. 21, 1998 (DE) ..... 198 48 621

(51) Int. Cl.[7] ..... C10L 1/22
(52) U.S. Cl. ..... 44/399; 44/351; 44/408; 44/418; 44/419
(58) Field of Search ..... 44/387, 346, 399, 44/408, 419, 418, 351

(56) References Cited

U.S. PATENT DOCUMENTS

| | | | | | |
|---|---|---|---|---|---|
| 5,376,155 | A | * | 12/1994 | Dralle-Voss et al. | 44/408 |
| 5,663,435 | A | * | 9/1997 | Dralle-Voss et al. | 564/153 |
| 6,071,993 | A | * | 6/2000 | Wenderoth et al. | 524/217 |

FOREIGN PATENT DOCUMENTS

| | | |
|---|---|---|
| DE | 1 149 843 | 6/1963 |
| EP | 0 106 234 | 4/1984 |
| EP | 0 203 812 | 12/1986 |
| EP | 0 398 101 | 11/1990 |
| WO | WO 95/33805 | 12/1995 |
| WO | WO 97/46640 | 12/1997 |

* cited by examiner

*Primary Examiner*—Cephia D. Toomer
(74) *Attorney, Agent, or Firm*—Oblon, Spivak, McClelland, Maier & Neustadt, P.C.

(57) ABSTRACT

The mixture contains (a) from 5 to 95% by weight of at least one reaction product of a poly($C_{2-20}$-carboxylic acid) having at least one tertiary amino group with secondary amines and (b) from 5 to 95% by weight of at least one reaction product of maleic anhydride and a primary alkylamine.

12 Claims, No Drawings

PARAFFIN DISPERSANTS WITH A LUBRICITY EFFECT FOR DISTILLATES OF PETROLEUM PRODUCTS

The present invention relates to mixtures suitable as paraffin dispersants having a lubricity effect, their use in mineral oil middle distillates, mineral oil middle distillates of this type and concentrates for this purpose.

Mineral oil distillates, in particular middle distillates, such as gas oils, diesel oils or light fuel oils, which are obtained by distillation from mineral oils, have different paraffin contents, depending on the origin of the crude oil. At relatively low temperatures, solid paraffins separate out (cloud point, CP). On further cooling, the lamellar n-paraffin crystals form a type of "house of cards structure" and the middle distillate sets although the predominant part of the middle distillate is still liquid. The flowability of the middle distillate fuels is considerably impaired by the precipitated n-paraffins in the temperature range between cloud point and pour point; the paraffins block filters and result in a non-uniform supply of fuel to the combustion units or completely stop said supply. Similar faults occur in the case of light fuel oils.

It has long been known that the crystal growth of the n-paraffins in the combustion or power fuels obtained from mineral oil distillates can be modified by suitable additives. Effective additives prevent middle distillates from becoming solid at temperatures of only a few degrees Celsius below the temperature at which the first paraffin crystals separate out. Instead, fine, well crystallized, separate paraffin crystals form, which crystals pass through filters in motor vehicles and heating systems or at least form a filter cake which is permeable for the liquid part of the middle distillates, so that trouble-free operation is ensured. According to European standard EN 116, the efficiency of the flow improvers is expressed indirectly by measuring the cold filter plugging point (CFPP).

Ethylene/vinyl carboxylate copolymers have long been used as flow improvers. The disadvantage of these additives is that, owing to their higher density compared with the liquid part, the precipitated paraffin crystals tend to settle out to an increasing extent on the bottom of the container on storage. Consequently, a homogeneous low-paraffin phase forms in the upper part of the container and a two-phase paraffin-rich layer at the bottom. Since the middle distillate is generally taken off slightly above the bottom of the tank, both in the vehicle tanks and in storage or delivery tanks of the mineral oil dealers, there is a danger that the high concentration of solid paraffins will block filters and metering means. This danger is all the greater the greater the amount by which the storage temperature is below the precipitation temperature of the paraffins, since the amount of precipitated paraffin increases with decreasing temperature.

These problems can be reduced by the additional use of paraffin dispersants (wax antisettling additives).

Thus, EP-A-0 398 101 describes reaction products of aminoalkylene polycarboxylic acids with long-chain, secondary amines as paraffin dispersants for mineral oil middle distillates. However, the effect is not sufficient in all mineral oil middle distillate compositions, particularly when they have a low sulfur content of less than 500 ppm.

DE-A-11 49 843 describes the use of maleamic acids and their amine salts obtained from primary amines and maleic anhydride as corrosion inhibitors and stability improvers for mineral oil distillates as well as for preventing sediment formation. EP-A-0 106 234 describes the use of amine salts of maleamic acids obtained from primary amines and maleic anhydride as corrosion inhibitors for the storage and the transport of crude oils.

Since October 1996, only low-sulfur middle distillates having a sulfur content of not more than 500 ppm may be used as diesel fuels in the European Union, which fuels, owing to said sulfur content, help to achieve exhaust gases having a lower pollutant content. From the year 2000 onward, the maximum permissible sulfur content of diesel fuels in the European Union may not exceed 350 ppm. However, such diesel fuels have a substantially reduced lubricity, which can in some cases lead to high mechanical wear in distributor injection pumps of diesel engines.

The lubricity of low-sulfur diesel fuels can be improved by adding lubricity additives. According to standard CEC F-06-A-96, the efficiency is determined by the HFRR test (High Frequency Reciprocating Rig test) by determining the wear size WS1.4 in $\mu$m at 60° C.; the smaller the WS1.4, the lower is the wear and the better is the lubricity.

There are numerous patent applications for products which can improve the lubricity of low-sulfur diesel fuels. WO 95/33805 states that flow improvers and paraffin dispersants, including reaction products according to EP-A-0 398 101, can improve the lubricity of middle distillates. However, the lubricity effect is not sufficient in many mineral oil middle distillate compositions.

It is an object of the present invention to provide improved products which ensure improved flowability of mineral oil middle distillates at low temperature by virtue of the fact that they have a dispersing effect such that settling of precipitated paraffins is delayed or prevented, and which simultaneously contribute to improved lubricity of the mineral oil middle distillates.

We have found that this object is achieved, according to the invention, by a mixture containing (a) from 5 to 95% by weight of at least one reaction product of a poly($C_{2-20}$-carboxylic acid) having at least one tertiary amino group with secondary amines and (b) 5–95% by weight of at least one reaction product of maleic anhydride and a primary alkylamine.

The present invention also relates to the use of these mixtures as additives for mineral oil middle distillates, in particular as paraffin dispersants and lubricity additives. The invention likewise relates to concentrates and mineral oil middle distillates containing these mixtures.

Component (a)

Component (a) is a reaction product of a poly($C_{2-20}$-carboxylic acid) having at least one tertiary amino group with secondary amines.

The polycarboxylic acid preferably contains at least 3, particularly preferably 3 to 12, in particular 3 to 5, carboxyl groups. The carboxyl groups in the polycarboxylic acid preferably have 2 to 10 carbon atoms, acetyl groups being preferred. The carboxyl groups are linked in a suitable manner to the polycarboxylic acid, for example via one or more C and/or N atoms. They are preferably bonded to tertiary nitrogen atoms which, in the case of a plurality of nitrogen atoms, are linked via hydrocarbon chains.

Component (a) is preferably an amide, amidoammonium salt or ammonium salt, or a mixture thereof, of aminoalkanecarboxylic acids of the formulae I and II

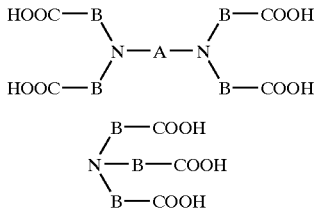

(I)

(II)

where A is straight-chain or branched alkylene of 2 to 6, preferably 2 to 4, in particular 2 or 3, carbon atoms, or a radical of the formula (III)

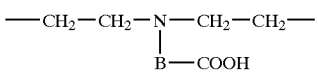

(III)

where B is a radical of 1 to 19 carbon atoms, preferably a $C_{1-19}$-alkylene radical, particularly preferably $C_{1-10}$-alkylene, in particular a methylene radical. A is preferably an ethylene radical.

The secondary amine may be selected from a multiplicity of amines which carry hydrocarbon radicals which may be bonded to one another.

The secondary amine is preferably of the formula $HNR_2$, where radicals R independently are straight-chain aliphatic radicals, in particular alkyl of 10 to 30, preferably 14 to 24, carbon atoms. They preferably have no hetero atoms or double or triple bonds. Preferably, the radicals R are identical.

The secondary amines can be bonded by means of amide structures or in the form of their ammonium salts to the polycarboxylic acid, also partly by means of amide structures and partly in the form of the ammonium salts. Preferably, little or no free acid groups are present.

Preferably, the amines are bonded completely in the form of the amide structures.

The amides or amidoammonium salts or ammonium salts of, for example, nitrilotriacetic acid, ethylenediaminetetraacetic acid or 1,2-propylenediaminetetraacetic acid, are obtained by reacting the acids with from 0.5 to 1.5, preferably from 0.8 to 1.2, mol of amine per carboxyl group.

The reaction temperatures are from about 80 to 200° C., the resulting water of reaction being continuously removed for the preparation of the amides. However, the reaction need not be continued completely to the amide; rather, from 0 to 100 mol % of the amine used may be present in the form of the ammonium salt. Particulary preferred amines are dioleylamine, dipalmitylamine, dicoconut fatty amine and dibehenylamine, in particular di-tallow fatty amine.

The novel components (a) of the mixture and their preparation are described in EP-A-0 398 101. The reaction product of one mole of ethylenediaminetetra-acetic acid and four moles of hydrogenated di-tallow fatty amine is particularly preferred.

If required, small amounts of conductivity improvers in the form of salts, in particular of hydrocarbon-soluble carboxylic acids and sulfonic acids or their metal and ammonium salts, may also be added to the components (a) of the mixture.

Component (b)

Preparation of the novel components (b) of the mixture is carried out in a manner known per se by reacting maleic anhydride with $C_{8-30}$-alkylamines, preferably primary $C_{8-18}$-alkylamines, in a molar ratio of 1:1 at from 70 to 100° C. by the process described in DE-A-11 49 843 and EP-A-0 106 234; suitable primary amines are all amines defined within these limits, for example straight-chain or branched octyl-, nonyl-, decyl-, undecyl-, dodecyl-, tridecyl-, tetradecyl-, pentadecyl-, hexadecyl-, heptadecyl- and octadecylamine and mixtures of these amines. The reaction product of one mole of maleic anhydride and one mole of tridecyl-amine is particularly preferred.

The novel mixtures can be prepared by simple mixing of the components (a) and (b); these mixtures are added to the mineral oil distillates in amounts of 10–1000 ppm, preferably from 50 to 500 ppm. The amount of the component (a) is from 5 to 95, preferably from 30 to 95, in particular from 50 to 90, % by weight and the amount of the component (b) is from 5 to 95, preferably from 5 to 70, in particular from 10 to 50, % by weight.

The novel polymer mixtures are used as additives for mineral oil middle distillates, which are understood as meaning petroleum, light fuel oils and diesel fuels having a boiling point of from about 150 to 400° C. The polymer mixtures may be added to the middle distillates directly but are preferably added as a 20 to 70% by weight strength solution (concentrate). Suitable solvents are aliphatic or aromatic solvents, such as xylene or mixtures thereof, and furthermore high-boiling aromatics mixtures, such as solvent naphtha, and middle distillates. The amount of mixture in the mineral oil middle distillates is as a rule from 10 to 10,000, preferably from 20 to 5000, particularly preferably from 50 to 1000, ppm.

As a rule, the middle distillates also contain flow improvers, for example based on ethylene/vinyl carboxylate copolymers. Depending on the intended use, the middle distillates may additionally contain further additives, e.g. conductivity improvers, corrosion-inhibiting additives, lubricity additives, anti-oxidants, metal deactivators, antifoams, demulsifiers, detergents, cetane number improvers and/or dyes and fragrances.

The novel mixtures result in a substantial improvement in the low-temperature flow properties in middle distillates, regardless of their origin, in that they effectively keep the paraffin crystals which separate out in suspension so that there is no blocking of filters and pipes by paraffin which has settled out. They have a broad action and thus ensure that the paraffin crystals which have separated out are very well dispersed in various middle distillates; at the same time, they help to improve the lubricity of the middle distillates.

The effect of the combination of the components (a) and (b) is substantially better than the effect of the individual components at the same dose.

The examples which follow illustrate the invention.

EXAMPLES

Example 1 (Component (a))

240 g (0.48 mol) of hydrogenated di-tallow fatty amine (Armeen® 2HT from Akzo) and 35 g (0.12 mol) of ethylenediaminetetraacetic acid were melted and were heated to 190° C., the resulting water of reaction being distilled off continuously. The reaction was terminated after about 25 hours at an acid number of less than 10 and an amine number of less than 1.1. By applying reduced pressure from a waterjet pump (2 hours, 120° C.), the water of reaction was removed completely. 265 g of a light brown, waxy solid were obtained. The product obtained was diluted with solvent naphtha so that the solids content of the product was 50% by weight.

Example 2 (Component (b))

A mixture of 98 g (1.0 mol) of maleic anhydride and 199 g (1.0 mol) of tridecylamine was heated in 250 ml of solvent naphtha at about 70° C. for 2 hours while stirring. The light brown, clear solution obtained was then diluted with solvent naphtha so that the solids content of the product was 50% by weight.

Use Examples:

The novel mixtures were tested in two commercial German winter diesel fuels which complied with European diesel fuel standard EN 590; they are designated as D1 and D2 and are characterized by the following physical data:

| | D 1 (97/526) | D 2 (96/86) |
|---|---|---|
| Cloud point (° C.) according to ISO 3015: | −6 | −6 |
| CFPP (° C.) according to EN 116: | −10 | −8 |
| Density at 15° C. (kg/m$^3$) according to ASTM D 4052: | 841 | 834 |
| Sulfur content (ppm) according to EN 24260: | 160 | 200 |
| WS1.4 (μm) according to CEC F-06-A-96: | 542 | |
| Distillation according to ISO 3405: | | |
| Initial boiling point (° C.) | 170 | 171 |
| 5% boiling point (° C.) | 203 | 193 |
| 10% boiling point (° C.) | 215 | 200 |
| 20% boiling point (° C.) | 235 | 212 |
| 50% boiling point (° C.) | 280 | 249 |
| 70% boiling point (° C.) | 308 | 282 |
| 90% boiling point (° C.) | 347 | 329 |
| 95% boiling point (° C.) | 364 | 345 |
| Final boiling point (° C.) | 371 | 360 |

The following mineral oil middle distillate compositions were tested:

Mineral oil middle distillate compositions containing 1. as paraffin dispersant one of the novel mixtures PD 1 (consisting of 83% by weight of component (a) from Example 1 and 17% by weight of component (b) from Example 2), PD 2 (consisting of 50% by weight of component (a) from Example 1 and 50% by weight of component (b) from Example 2), PD 3 (consisting of 67% by weight of component (a) from Example 1 and 33% by weight of component (b) from Example 2) or PD 4 (consisting of 90% by weight of component (a) from Example 1 and 10% by weight of component (b) from Example 2) and, as comparative examples, the respective individual components from Example 1 and Example 2 or none of the components (Comparative Examples V2, V3, V1). V1 thus contains only MDFI as additive and 2. as flow improver MDFI a product based on ethylene/vinyl carboxylate which is marketed under the tradename Keroflux® ES 6100 by BASF AG.

DESCRIPTION OF THE TEST METHOD

The middle distillates were mixed with the amounts, stated in the table, of the novel mixtures PD 1 to PD 4 or of Examples 1 and 2 and of the flow improver MDFI at 40° C. while stirring and then cooled to room temperature.

For the additive-containing middle distillate samples, the cold filter plugging point (CFPP) according to EN 116 was determined, and in some cases also the WS1.4 according to CEC-F-06-A-96.

The additive-containing middle distillates were cooled in 500 ml glass cylinders in a refrigerant bath from room temperature to −13° C. at a cooling rate of about 14° C. per hour and were stored at this temperature for 20 hours. The amount and appearance of the paraffin phase were then determined and assessed visually.

The cold filter plugging point (CFPP) according to EN 116 and the cloud point (CP) according to ISO 3015 were determined for the 20% by volume bottom phase separated off at −13° C. from each sample. The smaller the deviation of the cloud point of the 20% by volume bottom phase from the original CP of the respective middle distillate, the better are the paraffins dispersed.

The results obtained are shown in Tables 1 and 2:

TABLE 1

| | Dispersing experiments in D1, CP: −6° C., CFPP: −10° C., WS1.4: 542 μm | | | | | | | |
|---|---|---|---|---|---|---|---|---|
| | | | | | Paraffin | Dispersed | 20% bottom phase | |
| Mixture | Dose (ppm) | MDFI (ppm) | WS1.4 (μm) | CFPP (° C.) | sediment (% by volume) | paraffins (% by volume) | CFPP (° C.) | CP (° C.) |
| PD 1 | 150 | 200 | | −30 | 10 | 90 | −29 | −6 |
| PD 2 | 150 | 200 | 310 | −25 | 10 | 90 | −27 | −6 |
| PD 3 | 150 | 200 | | −26 | 10 | 90 | −28 | −6 |
| PD 4 | 150 | 200 | 328 | −28 | 10 | 90 | −27 | −5 |
| V1 | — | 200 | 526 | −25 | 44 | 0 | −18 | 0 |
| V2 | 150 | 200 | 394 | −25 | 46 | 54 | −20 | −2 |
| V3 | 150 | 200 | 369 | −23 | 42 | 58 | −23 | −3 |

TABLE 2

| | Dispersing experiments in D 2, CP: −6° C., CFPP: −8° C. | | | | | | |
|---|---|---|---|---|---|---|---|
| | | | | Paraffin sediment | Dispersed paraffins | 20% bottom phase | |
| Mixture | Dose (ppm) | MDFI (ppm) | CFPP (° C.) | (% by volume) | (% by volume) | CFPP (° C.) | CP (° C.) |
| PD 1 | 300 | 300 | −23 | 6 | 94 | −18 | −5 |
| PD 3 | 300 | 300 | −20 | 8 | 92 | −27 | −5 |
| PD 4 | 300 | 300 | −29 | 8 | 92 | −20 | −5 |
| V1 | — | 300 | −22 | 30 | 0 | −1 | +3 |
| V2 | 300 | 300 | −30 | 10 | 90 | −20 | −3 |
| V3 | 300 | 300 | −20 | 30 | 70 | −7 | +2 |

The test results show that, in the mineral oil middle distillates, the novel mixtures result in a lower cloud point of the 20% bottom phase than the mixtures of the comparative examples.

This shows that, in mineral oil middle distillates, regardless of their origin, the precipitated paraffin crystals are effectively kept in suspension by the novel mixtures of the components (a) and (b) so that filters and pipes are not blocked by paraffin which settles out. The novel mixtures have a very broad action and ensure that the paraffin crystals which separate out are very well dispersed in various middle distillates.

At the same time, the tests results show that, at the same total dose, the novel mixtures lead to a lower WS1.4 and hence to improved lubricity of low-sulfur diesel fuels then the respective individual components.

We claim:

1. A mixture containing (a) from 5 to 95% by weight of at least one reaction product of a poly($C_{2-20}$-carboxylic acid) having at least one tertiary amino group with secondary amines and (b) 5–95% by weight of at least one reaction product of maleic anhydride and a primary alkylamine.

2. A mixture as claimed in claim 1, wherein the poly($C_{2-20}$-carboxylic acid) having at least one tertiary amino group is of the following formula I or II

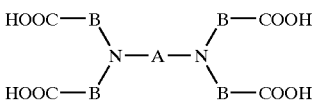

(I)

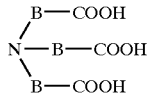

(II)

where A is a straight-chain or branched $C_{2-6}$-alkylene radical or a radical of the formula III

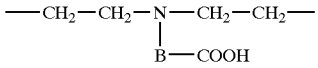

(III)

where B is a $C_{1-19}$-alkylene radical.

3. A mixture as claimed in claim 1, wherein the reaction product (a) is an amide, amidoammonium salt or ammonium salt in which no carboxyl group, one carboxyl group or a plurality of carboxyl groups is or are converted into amido groups.

4. A mixture as claimed in claim 1, wherein the secondary amine of the component (a) is of the formula $HNR_2$, where R is straight-chain or branched $C_{10-30}$-alkyl.

5. A mixture as claimed in claim 1, wherein the primary alkylamine of the component (b) is a $C_{8-30}$-alkylamine.

6. A mineral oil middle distillate containing a mixture as claimed in claim 1.

7. A mineral oil middle distillate as claimed in claim 6, further comprising flow improvers, conductivity improvers, corrosion-inhibiting additives, lubricity additives, antioxidants, metal deactivators, antifoams, demulsifiers, detergents, cetane number improvers, dyes, fragrances or mixtures thereof.

8. A concentrate containing 10–60% by weight, based on the total amount of the concentrate, of a mixture as claimed in claim 1, dissolved in the hydrocarbon solvent.

9. A mineral oil middle distillate as claimed in claim 6, further comprising flow improvers based on ethylene/vinyl carboxylate copolymers.

10. The mixture of claim 1, wherein said primary alkyl amine is at least one primary alkyl amine selected from the group consisting of straight-chain octyl amine, branched octyl amine, straight-chain nonyl amine, branched nonyl amine, straight-chain decyl amine, branched decyl amine, straight-chain undecyl amine, branched undecyl amine, straight-chain dodecyl amine, branched dodecyl amine, straight-chain tridecyl amine, branched tridecyl amine, straight-chain tetradecyl amine, branched tetradecyl amine, straight-chain pentadecylamine, branched pentadecylamine, straight-chain hexadecyl amine, branched hexadecyl amine, straight-chain heptadecyl amine, branched heptadecyl amine, straight-chain octadecylamine, branched octadecylamine, and a mixture thereof.

11. The mixture of claim 1, wherein said maleic anhydride and said primary alkyl amine are reacted in a molar ratio of 1:1.

12. The mineral oil middle distillate of claim 6, wherein said mixture is present in an amount of 10–1000 ppm.

* * * * *